United States Patent [19]

Rose et al.

[11] 4,226,073

[45] Oct. 7, 1980

[54] TRAY LOADER

[75] Inventors: Edward Rose, Skokie; Robert A. Roth, Chicago, both of Ill.

[73] Assignee: Peters Machinery Company, Subsidiary of Katy Industries, Inc., Chicago, Ill.

[21] Appl. No.: 35,687

[22] Filed: May 3, 1979

[51] Int. Cl.[3] ..... B65B 35/30; B65B 39/14

[52] U.S. Cl. ..... 53/532; 53/534; 53/247; 53/249

[58] Field of Search ..... 53/534, 531, 532, 147, 53/542, 247, 248, 249

[56] References Cited

U.S. PATENT DOCUMENTS

| | | |
|---|---|---|
| 1,279,562 | 9/1918 | Lowell . |
| 2,656,656 | 10/1953 | Murdoch et al. . |
| 2,755,907 | 7/1956 | McCullough et al. . |
| 2,936,557 | 5/1960 | Fay . |
| 3,084,783 | 4/1963 | Morton et al. . |
| 3,290,859 | 12/1966 | Talbot . |

*Primary Examiner*—Horace M. Culver

*Attorney, Agent, or Firm*—Hill, Van Santen, Steadman, Chiara & Simpson

[57] ABSTRACT

An automatic tray loading apparatus for cookies or the like in which cookies are divided into two rows with cookies in each row separated into groups of a given count and continuously conveyed to a loading station for loading into trays. A pair of drop chute members are aligned with the rows of cookies and each arranged to receive a discrete cookie group dropped therein by a drop gate device. The cookie group dropped into one of the drop chutes is moved laterally into close proximity to a second cookie group resting in the second drop chute to bring the cookie spacing into register with the spacing of cookie receiving compartments in the trays. Drop gate slides for each drop chute are then activated to open chute outlet openings to drop each cookie group into an appropriate compartment of a waiting cookie tray. A tray conveyor then carries away the cookie-filled tray and spots an empty tray below the drop chute outlet openings.

18 Claims, 12 Drawing Figures

FIG. 2
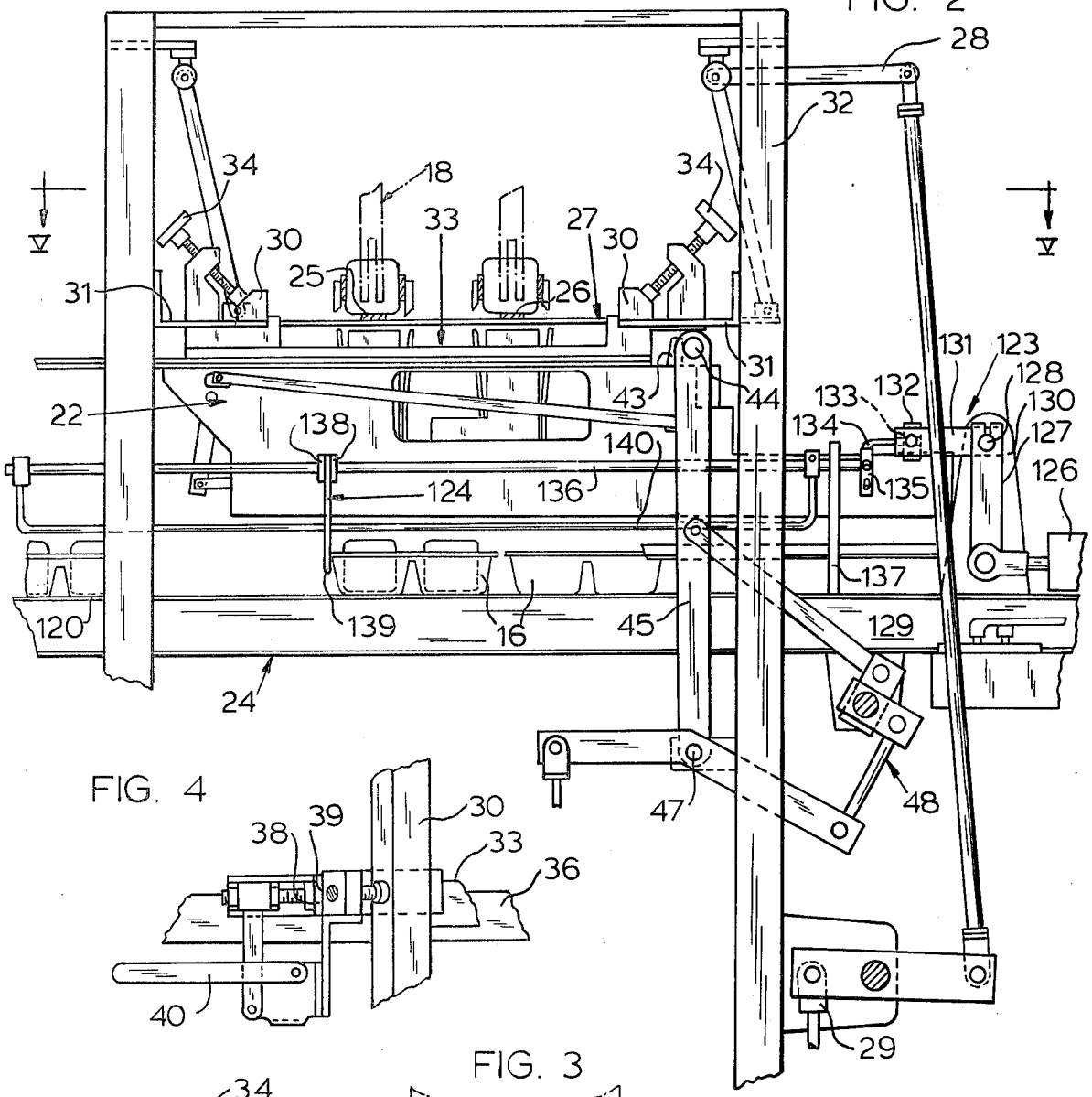
FIG. 4
FIG. 3
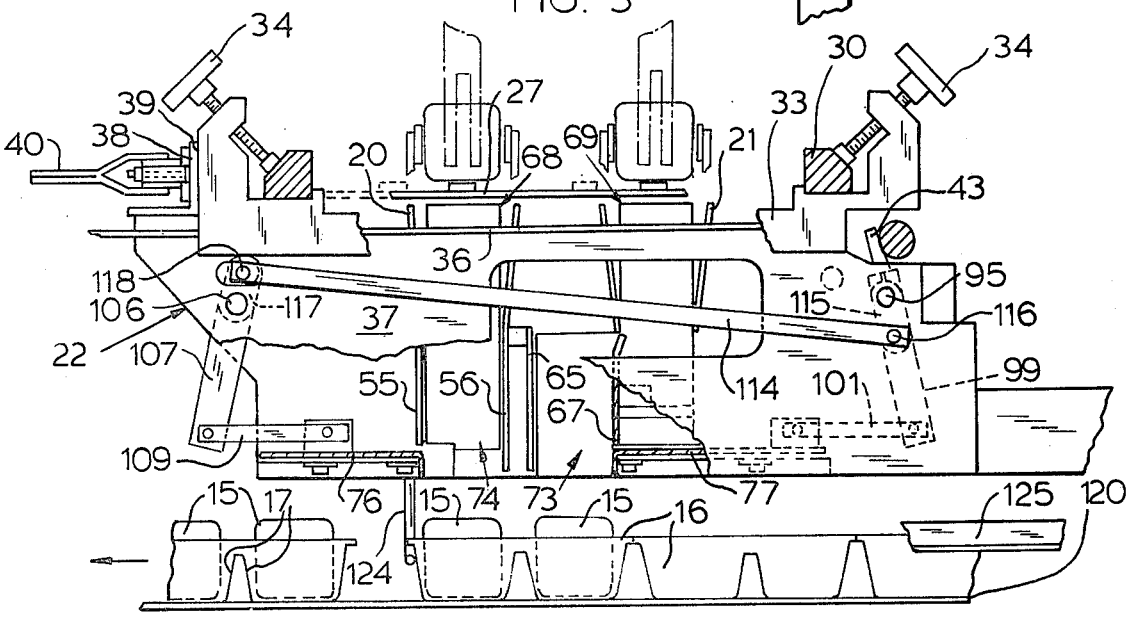

TRAY LOADER

BACKGROUND OF THE INVENTION

This invention is directed to an apparatus for automatically loading cookies and the like into trays or other containers commonly used to package them and more specifically to an improved tray loader which is especially well suited to handle various cookie shapes including square or rectangular forms.

Present tray loader devices, such as the machine shown and described in U.S. Pat. No. 3,290,859 issued Dec. 13, 1966, entitled "Tray Loader", have been extremely successful for tray loading round cookies but are not well suited in handling square or rectangular shapes. Herein, cookies such as cream filled sandwich types or the like are advanced to a loading station in parallel rows which have been separated into spaced groups of a given count for loading into an appropriate tray or box, the row spacing between cookies being fixed by conveyor and adjustment considerations. An aligned cookie group in each row is moved to a position over a related drop chute by a transfer conveyor while being supported on a pair of drop gate rails. The drop chutes are positioned and are of a suitable size to receive discrete cookie groups when the drop gate rails are activated. The cookies then fall downward through outlet openings in the bottom of the chutes and into a waiting box or tray with a complex guiding arrangement needed to direct cookies down into the trays. This guide arrangement requires retraction from interfering contact with the tray before the trays may be advanced. Since the spacing of the cookie rows moving along the transfer conveyor is greater than the desired spacing between cookie groups deposited in the boxes, the drop chutes are equipped with angled converging guide walls to urge the cookie groups together as they fall through the chutes for delivery into the trays at an appropriate spacing. These angled guide walls have, however, resulted in frequent chute "jam up" when the apparatus is required to load square cookies. Jamming, apart from interrupting production and wasting cookies, may also result in damage to the tray loading apparatus before the loading operation can be shut down.

Accordingly, a tray loading apparatus, which can accommodate various cookie shapes including square ones without damaging the cookies and without jamming, would be a decided advance in the state of the art.

SUMMARY OF THE INVENTION

An automatic tray loading apparatus receiving cookies from a conveyor in a continuous flow and separating them into spaced groups of uniform count in two parallel rows for movement to a loading station along a transfer conveyor. A pair of parallel drop chutes are located in a cookie receiving position with respect to the two parallel rows, each having a width and length sufficient to receive a cookie group of a predetermined number. A drop gate supports the cookie groups while moving into position above the drop chutes and when activated, drops the cookies straight downward into a lower portion of the drop chutes through which square cookies will freely fall without jamming. A lower portion of one of the drop chutes terminates in an outlet opening which is normally closed by a drop gate slide to retain the cookie groups until the slide is activated. A lower portion of the other drop chute is enlarged in width, providing space for a cookie group to be shifted laterally toward the other drop chute and into position above an outlet opening which is normally blocked by a second drop gate slide. A transfer plate, forming a lower wall of the chute, is extensible to advance cookies dropped into the chute into position above the outlet. The outlet openings are spaced apart a distance equal to the spacing between cookie receiving compartments of a tray advanced along a tray conveyor into a receiving position below the outlet openings. A powered activating linkage simultaneously opens both drop gate slides to deposit both cookie groups into a respective compartment of a positioned tray. The filled tray is automatically advanced for packaging with an empty tray spotted below the outlet openings by an automatic sequencing arrangement which provides a continuous reliable tray filling operation at a high rate of loading.

The apparatus, of course, may load various forms of cookies and need not necessarily be used only to load square cookies.

Further, since the cookie groups drop only a small distance into the lower portion of the drop chutes and subsequently are dropped a short distance into the trays, sequencing and positioning of the tray compartments become more accurate and simple to control; wherein the total drop distance into the trays is made in two stages wherein the cookies dropped in minimum height increments minimize cookie breakage and more uniform tray loading.

Another embodiment of the invention provides a tray loading apparatus with a pair of angled chutes adapted to move the cookie groups, which may include certain generally square shaped cookies, closer together as they are dropped into a lower portion thereof, the lower portions each terminating in an outlet opening normally closed by a drop gate slide. The cookies dropped in the drop chute are thus guided into compatible spacing with tray compartments in positions immediately thereabove. Actuation of the drop gate slides allows the cookie groups to fall only a short distance into waiting trays which is also easy on the cookies and lessens cookie disarrangement in the trays which might otherwise occur when cookies are dropped from greater heights. Further, no complex guide plate arrangements are needed to direct the cookies down into their trays as required with the prior art.

A principle object of the present invention is: to provide an apparatus, receiving cookies from a production line in a continuous flow, divide them into discrete spaced groups of a given count for advancing into a loading station in a pair of side-by-side parallel rows, and then loading the cookies into trays in a continuous automatic operation.

Another object of the invention is to provide an improved tray loading apparatus which will readily accommodate square cookies and eliminate faulty tray loading associated with devices dropping cookies from excess heights.

Yet another object of this invention is to provide a simplified and effective form of drop chute arrangement for loading falling groups of cookies into a tray in which two cookie groups are dropped straight downward into a pair of drop chutes whereupon one of the cookie groups is shifted laterally by a movable wall of the drop chute to position the cookie groups at a desirable side-by-side spacing which is complementary to the spacing between cookie receiving compartments of the tray to be loaded.

A further object of the invention is to provide a novel and improved drop chute device for a tray loading apparatus in which a pair of parallel cookie groups are brought into a desired spacing relation to one another in connection with a first phase of the drop cycle and thereupon depositing the cookie groups into tray compartments during a second phase of the drop cycle.

These and other objects, features, and advantages of the invention will become apparent from the following description of the preferred embodiments thereof taken in conjunction with the accompanying drawings.

BRIEF DESCRIPTION OF THE DRAWINGS

FIG. 2 is an enlarged sectional view taken generally along the line II—II of FIG. 1;

FIG. 3 is an enlarged fragmentary view of the drop chute assembly of FIG. 2, showing the drop gates in their retracted positions;

FIG. 4 is a fragmentary view of the clamping device for retaining the drop chute assembly in the apparatus;

DESCRIPTION OF THE PREFERRED EMBODIMENTS

Figure 1:
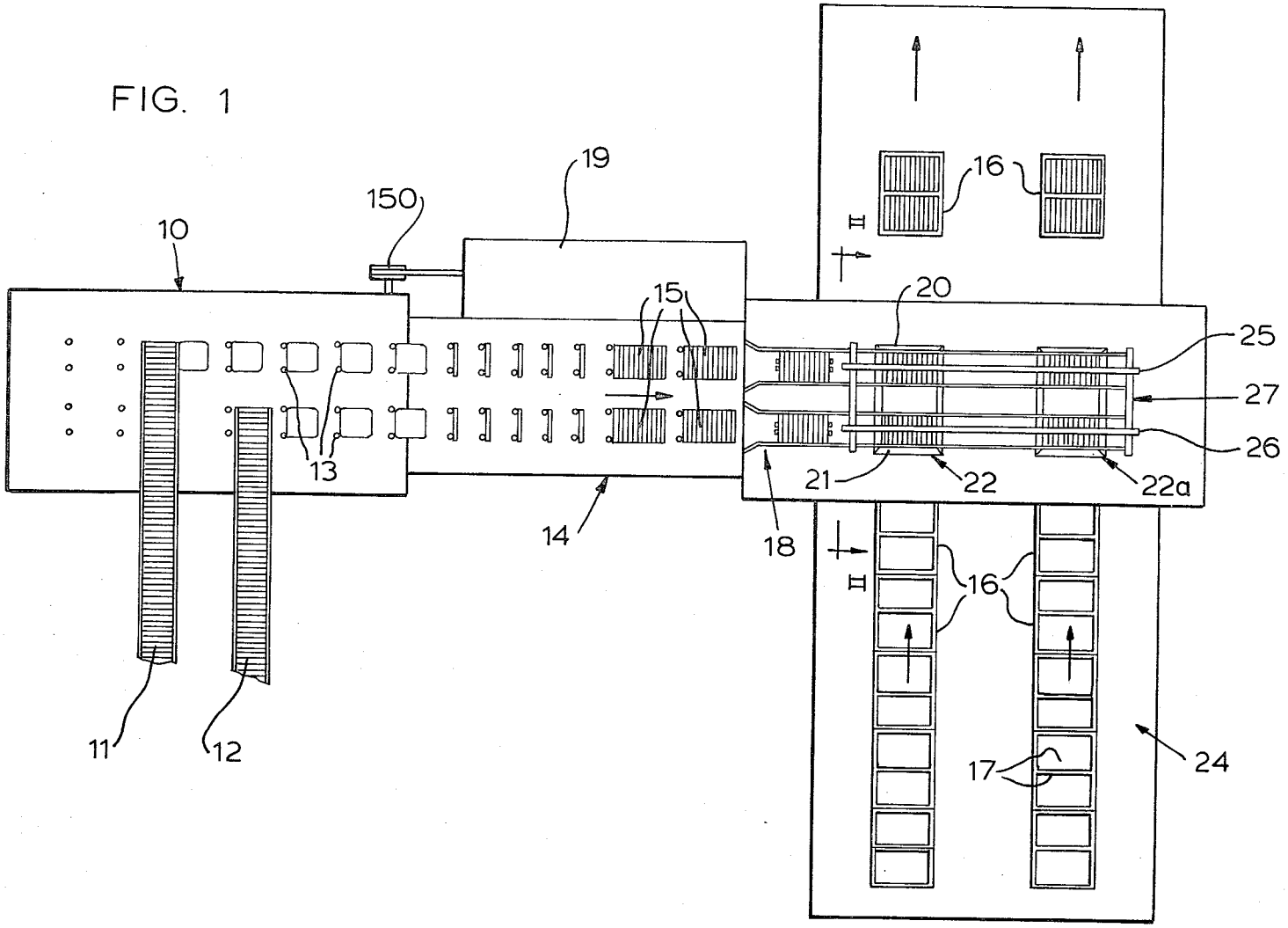
FIG. 1 is a schematic plan view diagrammatically showing a loading apparatus for cookies or the like embodying features of the invention.

FIG. 1 illustrates diagrammatically a sandwiching machine 10 which receives an inflow of square cookies from a pair of feed conveyors 11 and 12 and places a cream filler between every two cookies to form sandwiches. Conveyors 13, 13 thereupon move the sandwiched cookies in two spaced rows to a counting and separating conveying device 14 for separating each row of cookies into uniform spaced counted groups 15. A predetermined quantity of the cookie groups 15 is based on the capacity of cartons or trays 16 being loaded. The trays 16 shown herein comprise molded members having a pair of closely spaced cookie receiving compartments 17, 17 in each tray. Obviously, various other tray configurations may be equally well suited for use in the present apparatus as well as various other cookie shapes and types.

Counted cookie groups are removed from the counting and separating conveyor 14 by an intermittently driven transfer conveyor assembly 18, driven by an intermittent drive 19 which provides a dwell period in the travel of the transfer conveyor assembly 18 to accommodate dropping the cookie groups 15, 15 into a pair of drop chute members 20, 21 of a drop chute assembly 22. Thereafter, the cookie groups are repositioned (moved together) and dropped into receiving, side-by-side, compartments 17, 17 of trays 16 positioned in a cookie loading position below the drop chute assembly 22.

The sandwich machine 10, the counting and separating conveyor 14 and the transfer conveyor 18, along with their mode of operation, are shown and described in the accompanying U.S. Pat. No. 3,290,859 in which the cookie handling is the same as in the present invention. Said patent is assigned to the assignee of the present invention and is incorporated herein as a part hereof.

The cookie groups 15, 15 picked up by the transfer conveyor 18 are guided and conveyed in a manner similar to the aforementioned patent, to a position immediately above the drop chutes 20 and 21, along support rails 25, 26 of a drop gate device 27. The drop gate support rails 25, 26 are shifted laterally out of supporting relation with respect to the cookies during a dwell period in the transfer conveyor travel to accommodate simultaneously dropping cookie groups in each row, into a respective one of the drop chutes. The drop gate device 27 is laterally shifted by a linkage arrangement 28 and in a suitable sequenced timing by an activating arrangement 29 in a manner generally similar to the arrangement described in U.S. Pat. No. 3,290,859. The spacing between the cookie rows is fixed at a minimum dimension, being determined by space requirements for conveyor elements and which spacing is considerably greater than the spacing between the cookie receiving compartments 17, 17 of the trays 16.

Referring now in particular to the drop chute arrangement, it should be understood that where two spaced groups of sandwiched cookies are conveyed along each of the drop gate support rails 25, 26 by the transfer conveyor 18, a pair of drop chute assemblies 22 and **22*a* are provided for the groups of cookies wherein two groups of cookies on each support rail are simultaneously loaded into a pair of side-by-side trays, as generally shown in FIG. 1. This arrangement is generally utilized when the sandwich group count is under 10. For counts of 10 and over, only one drop chute assembly 22 is provided to load the two rows of cookie groups into the trays 16 moved laterally in cookie receiving relation along a tray conveyor 24** below the drop chute assembly.

Now with reference to FIG. 2 of the drawings, the drop chute assembly 22 is adjustably mounted on parallel spaced bars 30, spaced above and extending transversely of the tray conveyor 24. The bars 30 are mounted at their opposite ends on angles 31 carried on a frame structure 32 and extend horizontally along opposite sides of the transfer conveyor 18.

Figure 7:
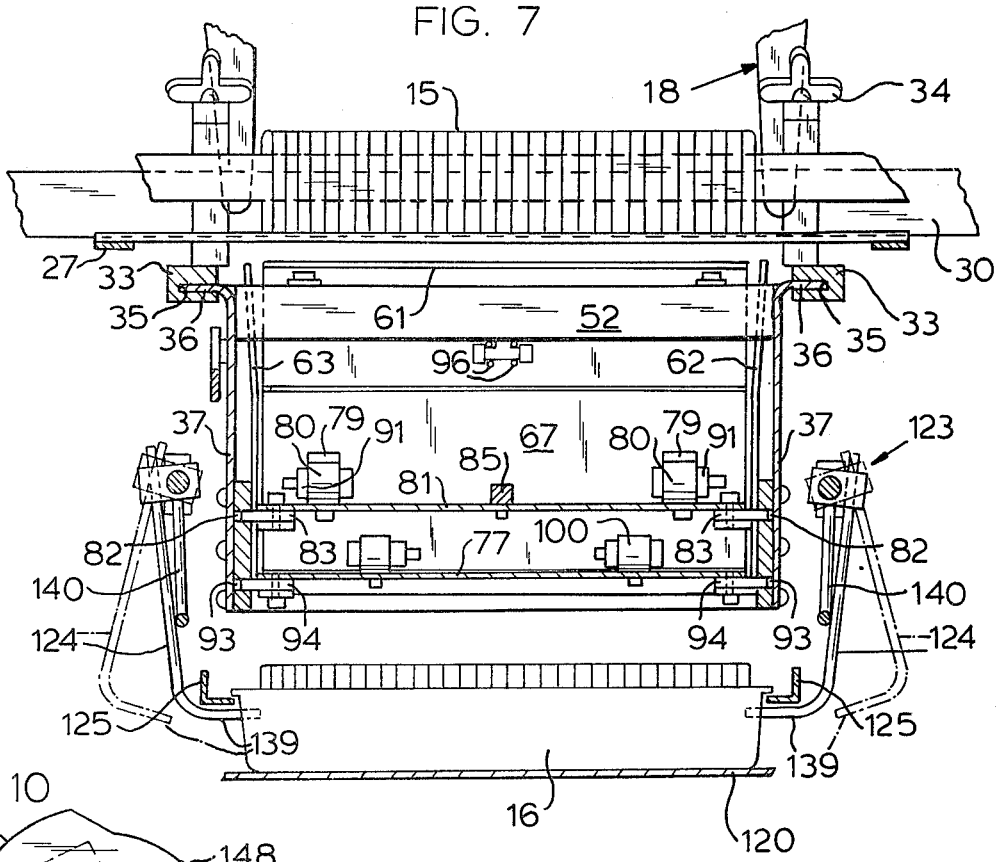
FIG. 7 is a vertical sectional view at a reduced scale taken generally along the line VII—VII of FIG. 6.

The drop chute assembly 22 is adjustably supported from the parallel spaced bars 30 on a pair of transverse supports 33 with each of the drop chute members 20 and 21 aligned with one of the cookie rows advancing along the transfer conveyor assembly 18. A pair of clamping screws 34 are provided to adjustably secure each support 33 in position across the spaced bars 30. The supports 33 each provide a recessed slot 35 which are arranged to receive a supporting flange 36 extending outward from side plates 37 of the drop chute assembly 22 as best seen in FIG. 7. Herein, the flanges 36 are slid into the slots 35 from the left side of the apparatus as seen in FIG. 3, to a point where an abutment angle 38 abuts a stop face 39 of the support 33.

A hand operated clamp 40 carried on the supports 33 secures the drop chute assembly 22 in operative position. Thus, it may be seen that the drop chute assembly 22 is easily removed from the apparatus for servicing and cleaning and various other drop chute assemblies may be quickly substituted for specific cookie loading applications. When the drop chute assembly 22 is fully installed in the slots 35 of the supports 33, an upward extending lever arm 43 is brought into an operative position relative to a horizontal actuator rod 44. The rod 44 extends transversely of the tray conveyor 24 and is mounted at each end to a lever arm 45 for pivotal movement about a pivot pin 47. An activator linkage 48 is sequentially activated by a suitable cam drive arrangement (not detailed) similar to the arrangement used in the aforementioned patent to pivotally rock the lever arm 45 to advance the rod 44 against the lever arm 43.

Figure 5:
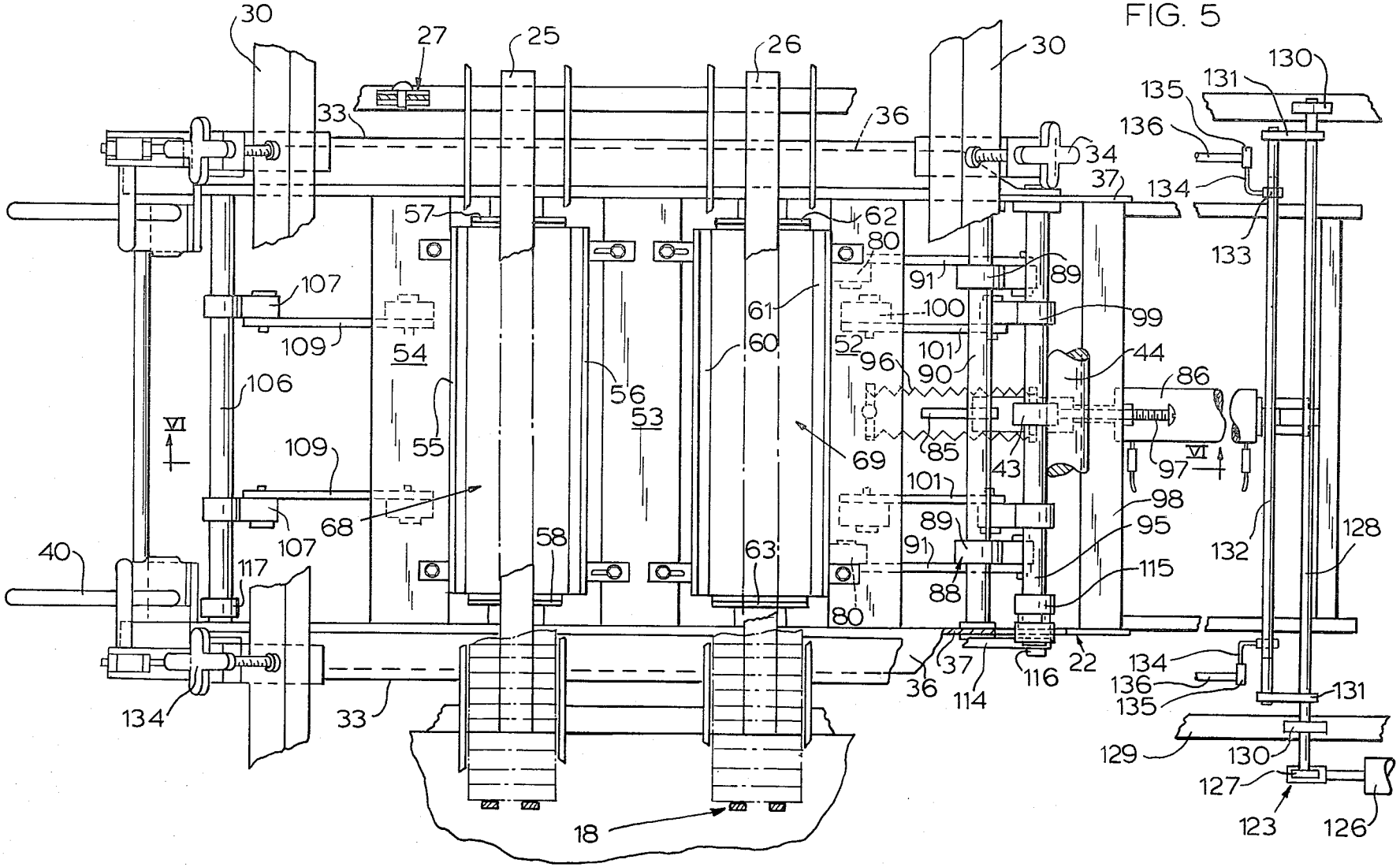
FIG. 5 is a sectional view in plan taken along the line V—V of FIG. 2.
Figure 6:
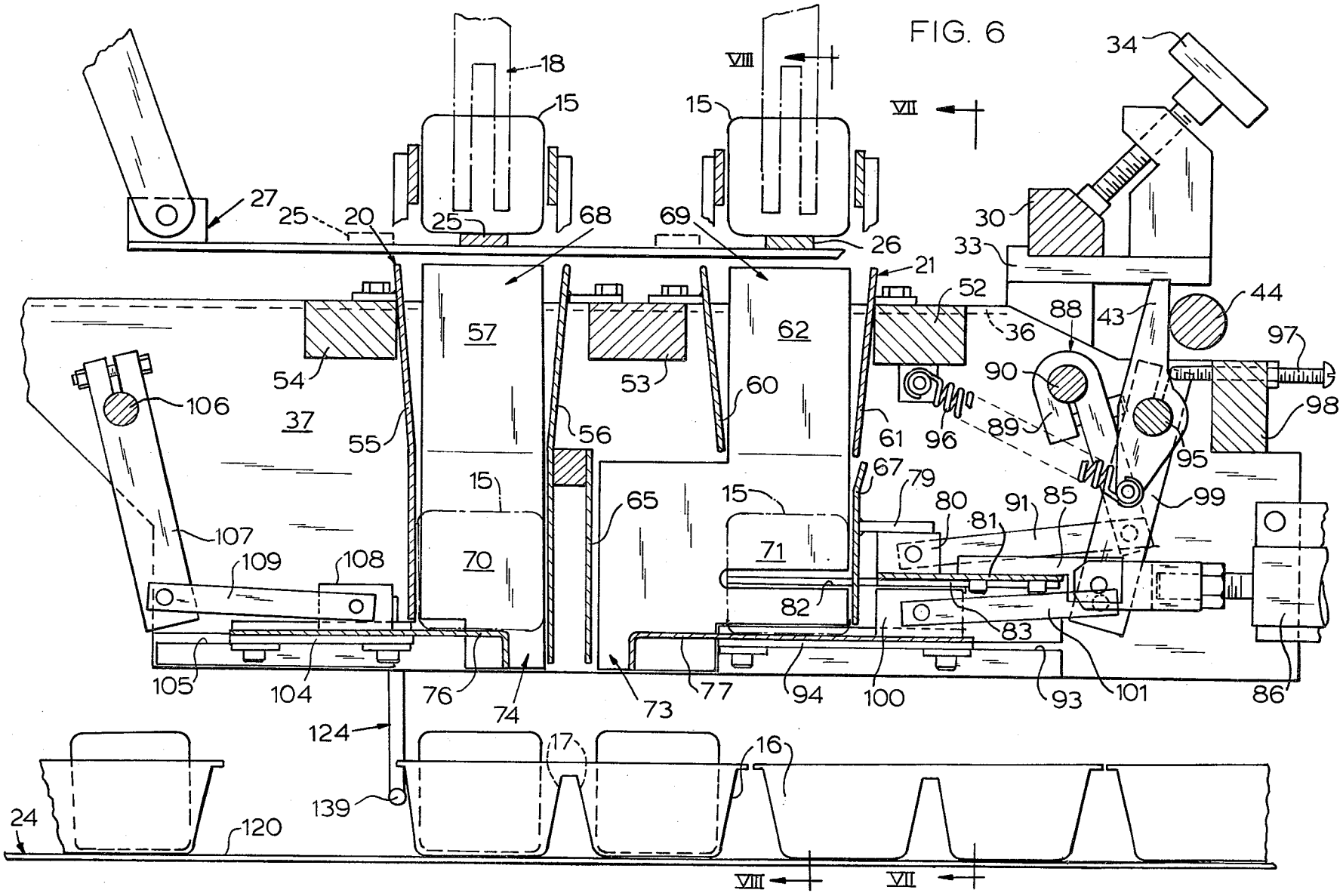
FIG. 6 is an enlarged vertical sectional view taken along the line VI—VI of FIG. 5.

As best seen in FIGS. 5 and 6, the side plates 37 of the drop chute assembly 22 are connected in spaced relation by a plurality of cross bars 52, 53 and 54. These cross bars further serve to support chute walls 55, 56, 57 and 58 of the drop chute member 20 and chute walls 60, 61, 62 and 63 of the drop chute member 21. An offset chute wall 65 of the drop chute member 21 is carried on an adjacent wall 56 of the member 20 as shown in FIG. 6. A transfer wall 67 forms a continuation to the wall 62. The upper portions of the chute walls 55 to 58 and 60 to 63 are flared outward to define upper or receiving openings 68 and 69 of the drop chute members 20 and 21, and which walls are arranged to guide cookie groups 15 straight downward into lower portions 70 and 71 of the drop chute members 20 and 21, respectively.

It will be seen in FIG. 6 that the lower portion 71 comprises an area having an enlarged width, as defined by the walls 65, 62, 67, and 63. The drop chute member 21 terminates in an outlet opening 73, disposed laterally of the receiving opening 69 and at a spacing with respect to an outlet opening 74 of the drop chute 20 which is in conformity to the spacing between the cookie receiving compartments 17, 17 of the trays 16. The outlet openings are normally blocked by drop gate slides 76 and 77 to retain cookie groups 15, 15 in the lower portions 70 and 71 until the cookie group 15 in lower portion 71 is shifted laterally toward the chute wall 65 and into a tray loading drop position in register with the tray compartments 17, 17.

The transfer wall 67 cooperates with the chute wall 61 to provide a cookie guiding surface down into the lower portion 71. The transfer wall 67 further provides the means to laterally shift the cookie group into the tray loading position directly above a related tray compartment. Herein, the transfer wall 67 extends laterally of the side plates 37 (as best seen in FIG. 7) and includes a pair of mounting lugs 79 for securing the wall 67 to mounting block 80 carried on a horizontal slide plate 81. The plate 81 is supported on the side plates 37 in guide slots 82 for translational movements by means of a pair of linear bearing slides 83 attached to each side of the plate 81. The slides 83 are preferably formed of a bearing quality plastic material to provide a smooth wear resistant motion.

A central connecting block 85 carried on the slide plate 81 provides an attachment for a pneumatic cylinder 86 which is arranged to cyclically advance the plate 81 with the attached transfer wall 67 to move a cookie group 15 laterally into a tray loading position. The translational movements of the slide plate 81 are stabilized by an equalizer linkage 88 to insure that the transfer wall 67 remains parallel to the chute walls 61 and 65. Herein, a pair of spaced lever arms 89 are clamped to a pivot shaft 90 and extend downward with each lever arm 89 connected to one of the mounting blocks 80 by means of a link 91. Thus, both sides of the slide plate 81 move in unison without the possibility of undesirable angular distortions which could interfere with shifting the cookie groups to a required tray loading position.

The drop gate slide 77 is supported on the side plates 37 in guide slots 93 by means of a pair of linear bearing slides 94 which are attached to opposite sides of the drop gate slide 77 for translational movements in a manner similar to the slide plate 81. Moving the drop gate slide 77 horizontally in a retracting direction, is effective to open the outlet opening 73 and allow a positioned cookie group 15 to drop into a tray 16 therebeneath. The drop gate slide 77 is retracted by activation of the actuator rod 44 as previously described, which pivots the lever arm 43 in a counterclockwise direction as seen in FIG. 6, to rotate a control shaft 95 carrying the lever arm 43. The lever arm 43 is pivotably biased in a clockwise direction by springs 96 to an abutting position with an adjustable screw stop 97 carried in a cross bar member 98 of the drop chute assembly 22.

A pair of spaced lever arms 99 is secured to and pivots with the shaft 95, with downward extending ends pivotably connected to a pair of spaced connecting blocks 100 by means of a connecting link 101. The blocks 100 are affixed to the drop gate slide 77. It should be appreciated that the shaft 95, lever arms 99 and links 101 are effective to stabilize the extending and retracting translational movements of the drop gate slide 77.

The drop gate slide 76 is guided for translational movements in a manner similar to the drop gate slide 77 on a pair of bearing slides 104 carried in guide slots 105, as may be seen in FIG. 6. Further, a control shaft 106 is provided with a pair of spaced lever arms 107 with the lower ends thereof connected to blocks 108 by means of connecting links 109, whereby the drop gate slide is retracted by clockwise rotational movement of the control shaft 106. As best seen in FIGS. 3 and 5, a motion transmitting cross link 114 is effective to impart an equal and opposite rotational motion to the control shaft 106 in response to the rotational movements of the control shaft 95. Herein, a short lever 115 affixed to the shaft 95 carries one end of the cross link 114 on a pivot pin 116 with the other end of the cross link 114 connected to a second short lever arm 117 with a pivot pin 118. The second lever arm 117 is secured to the control shaft 106 in a position which is substantially diametrically opposite to the mounted position of the lever arm 115. Thus, it will be appreciated that when the control shaft 95 is rotatably activated to retract the drop gate slide 77 and drop a group of cookies into an appropriate tray compartment 17 the cross link arrangement will simultaneously retract the drop gate slide 76 to drop a second group of cookies into a second tray compartment. The springs 96 are effective to close the drop gate slides 76 and 77 when the activating force applied to the lever arm 43, by the actuator rod 44, is terminated.

Now with particular reference to FIG. 2, the tray conveyor 24 is seen to include an endless belt 120 which is orbitally driven by a suitable drive (not detailed) to advance a stream of trays therealong through a loading station whereby trays are individually filled with cookie groups 15 from the drop chute assembly 22 in an operating manner generally shown and described in the U.S. Pat. No. 3,290,859. Each of the trays 16, in turn, is spotted below the drop chutes by a tray positioning arrangement generally designated 123. Herein, tray stops 124, positioned below each side of the drop chute assembly, are utilized to retain an empty tray 16 in a loading position for a time duration sufficient to drop the cookie groups 15 into the trays from the drop chute assembly and thereupon release the tray for downstream travel along the continuous moving belt 120 to advance the filled tray to a discharge area for packaging. The tray stops 124 intercept a leading edge of a tray 16 to position it in a cookie receiving position directly under the drop chute outlet openings 73, 74. Additional succeeding empty trays, riding on the belt 120 upstream of the drop chute and in abutting relation with one another, are also stopped with the interception of the lead tray by the tray stops 124. The trays are aligned and guided along the conveyor 24 by suitable guide rails 125 which are described in detail in the U.S. Pat. No. 3,290,859.

The tray positioning arrangement 123 is powered by an air cylinder 126 which is connected to a free end of a lever arm 127 to impart a rocking motion to a cross shaft 128. The cross shaft 128 is pivotally supported on a conveyor supporting frame 129 by means of a pair of spaced support brackets 130 and has rocking arms 131 at opposite end portions thereof. A slotted drive bar member 132 is pivotally carried on the rocking arms 131 and has a slot 133 extending for substantially the length thereof. The slot 133 is engaged by a pair of crank arms 134 which extend from mounting blocks 135 carried on a rear end portion of shafts 136, pivotally supported on brackets 137 at each side of the drop chute assembly 22. The crank arms 134 move up and down with the drive bar member 132 to impart a rocking movement to the shafts 136. The slot 133 accommodates adjustment of the tray stops 124 on opposite sides of the tray conveyor 24 towards and from each other in accordance with the tray size to be loaded. Each shaft 136 carries one of the stops 124 for free pivotal movement thereon and retained in a suitable tray positioning location by a pair of spaced collars 138.

The tray stops 124 each include a stop finger 139 extending down and inward from their supporting shafts 136 and are biased by gravity into a tray intercepting orientation in the path of travel of a tray moving along the tray conveyor 24. A generally U-shaped rod 140 extends along the insides of each stop fingers 139 and is secured to the shaft 136 for rocking movement therewith. Rocking of the shafts 136 is controlled by the air cylinder 126 to urge the U-shaped rods 140 against the insides of the stop fingers 139 and momentarily withdraw the stop fingers from the path of travel as shown in broken lines in FIG. 7, of an associated tray 16 to accommodate the advance of a filled tray to a discharge area, and allow the next succeeding tray to move into a loading position. The stop fingers are withdrawn from the path of travel of the tray for a time sufficient to accommodate the tray to move past the stop finger's grasp. Thereafter, the air cylinder moves the U-shaped rods away from the stop fingers whereby gravity will again swing them into a tray retaining position to spot the next tray in a loading position.

Figure 10:
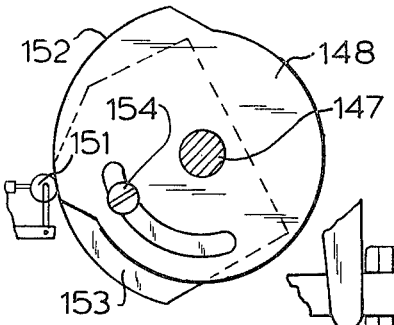
FIG. 10 is a fragmentary detailed view of the cam wheel for controlling the transfer wall.
Figure 8:
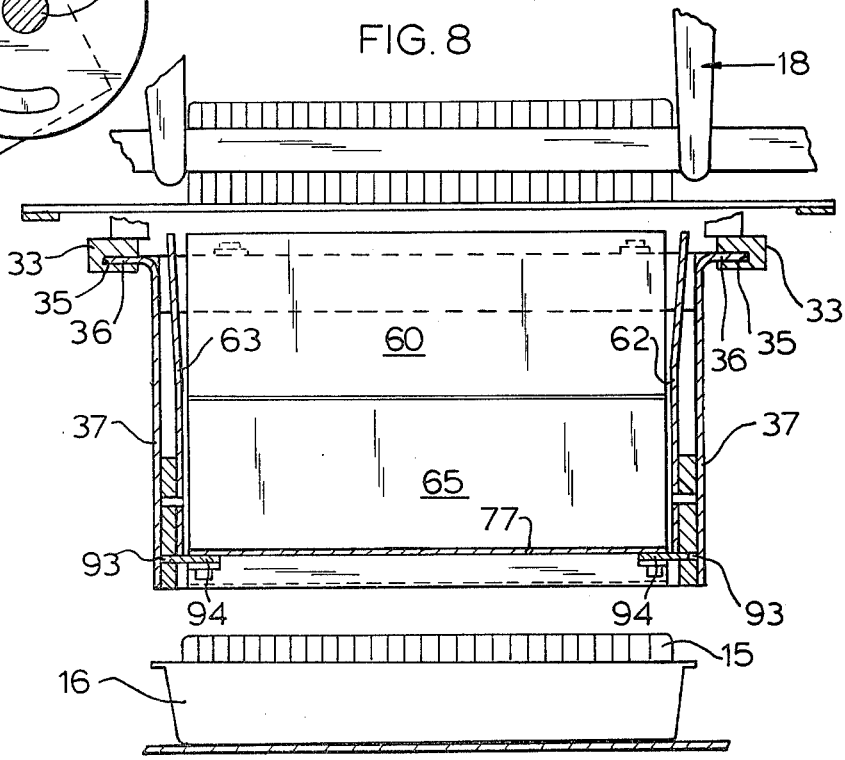
FIG. 8 is a vertical sectional view at a reduced scale taken generally along the line VIII—VIII of FIG. 6.
Figure 9:
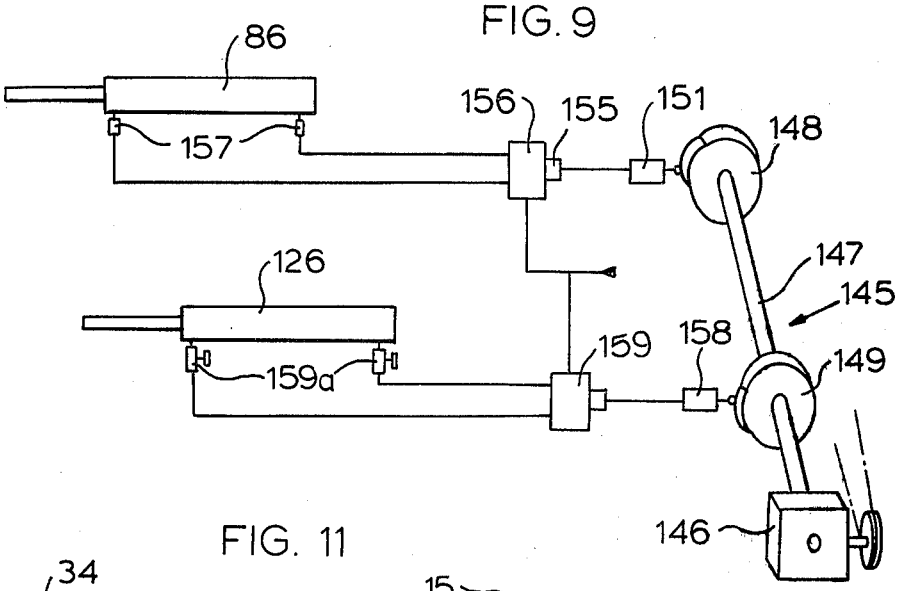
FIG. 9 is a diagrammatic view of the control system for the transfer wall and the tray positioning arrangement.

The air cylinders 126 and 86 are controlled for sequential and timed operation of the transfer wall 67 and the tray stops 124 by a control system generally designated 145 (see FIG. 9). The system 145 includes a gear box 146 which is driven in synchronism with other tray loading apparatus components by a suitable power source (not detailed) which preferably derives power from a power take-off 150 at the sandwich machine 10 (see FIG. 1). The gear box 146 rotatably drives a cam shaft 147 having a pair of cam wheels 148, 149 secured thereto. As best seen in FIG. 10, the cam wheel 148 includes a cam face 152 which is operatively associated with a microswitch 151 and includes a cam face extension 153 which may be adjusted by means of a screw 154 to provide a desired timed control of the microswitch 151. The microswitch 151, when closed by the cam face, energizes a solenoid 155 of an air valve 156 which is arranged to direct air pressure to one end of the cylinder 86 to advance the transfer wall 67 and thereby shift a cookie group 15 into a suitable tray loading position in the drop chute member 21. When the cam faces 152, 153 rotate to the position where the microswitch 151 is allowed to open, the solenoid 155 deenergizes and the air valve thereupon directs air pressure to the other end of the cylinder 86 to retract the transfer wall 67 in readiness for receiving a cookie group 15 in the drop chute member 21. Quick-connect fittings 157 may be provided to accommodate quick and easy removal of the entire drop chute assembly 22 from the machine.

The cam wheel 149 is constructed similar to the cam wheel 148 and is operably associated with a microswitch 158. The microswitch 158 controls a solenoid operated valve 159, similar to the valve 156 for directing air pressure to the cylinder 126 for operation of the tray positioning arrangement 123. A flow control valve **159*a* is provided in the pressure lines directing air pressure to the cylinder 126** for adjustably controlling the rate of cylinder movement.

Figure 11:
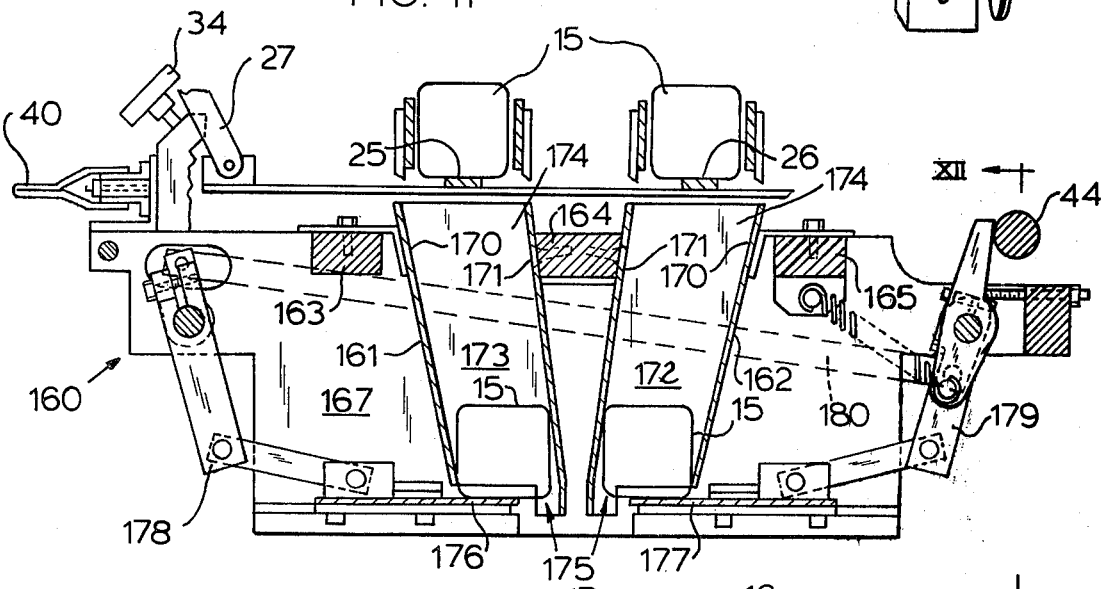
FIG. 11 is a sectional view similar to FIG. 6 but showing an alternate embodiment of this invention.
Figure 12:
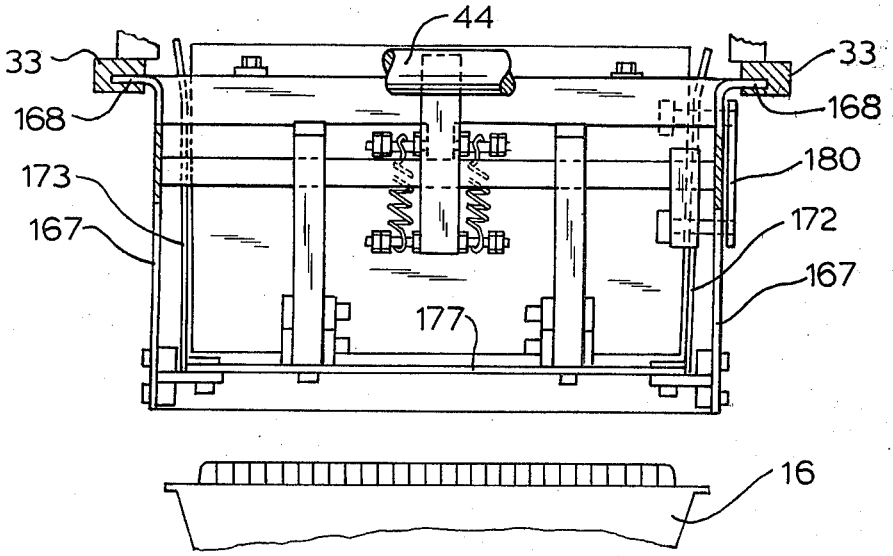
FIG. 12 is a sectional view taken generally along the line XII—XII of FIG. 11.

Now with particular reference to FIGS. 11 and 12, an alternate embodiment of the invention is shown as including a drop chute assembly 160 having a pair of drop chute members 161, 162. The drop chute assembly 160 may be interchangeably used in a tray loading apparatus as the assembly 22 described in the foregoing and may be utilized in loading certain cookie shapes including some having a generally square configuration. Herein, the drop chute members 161, 162 are supported from cross bars 163, 164 and 165 extending between a pair of side plate members 167. The side plate members 167 include supporting flanges 168 for suspending the assembly 160 from the supports 33 in the manner described above.

The drop chute members are generally mirror images of one another and include oppposed, angled side walls 170, 171 and a pair of generally vertical end walls 172, 173 defining inlet openings 174 at a top portion, and outlet openings 175 at a lower portion of each member. The outlet opening 175 of the drop chute 161 is normally blocked by a drop gate slide 176 and the outlet opening of the drop chute 162 is normally blocked by a drop gate slide 177. The angled side walls 170 and 171 are arranged to guide cookie groups 15, 15, dropped into the receiving openings 174 of the drop chutes 161 and 162, toward one another, whereby the two cookie groups will assume a suitable tray complementary loading spacing at the lower portions of the chutes. Thus, the cookie groups 15, 15 are repositioned from the wide spacing between the cookie rows moving along the support rails 25, 26 of the drop gate device 27 to the narrow spacing between compartments 17, 17 of the trays, while the cookie groups are dropping into the drop chutes.

When the tray is in position directly beneath the outlet openings 175, the drop gates are activated by operating linkages 178 and 179 similar to the embodiment described above. Further, the linkages 178 and 179 are concurrently activated by a motion transmitting cross linkage arrangement 180 in a manner similar provided by the cross link 114 of the first embodiment.

Although our invention has been described with references to certain specific embodiments, it is to be understood that these are by way of illustration and that variations and modifications may be affected without departing from the spirit and scope of the novel concepts of our invention. Furthermore, although air cylinders and valves have been utilized in the above disclosed embodiments it should be understood that hydraulic cylinders and valves may be equally well suited for use in some applications.

We claim as our invention:

1. In an apparatus for loading cookies and the like into trays for packaging, at least one cookie receiving tray having aligned successively arranged compartments therein, a transfer conveyor transferring counted groups of cookies for loading into said compartments, a tray conveyor disposed beneath and extending transversely of said transfer conveyor, drop gates movable to release counted groups of cookies from said transfer conveyor for loading into said compartments, an individual drop chute extending beneath each drop gate for guiding groups of cookies released by said drop gates to said compartments, the improvement comprising:

release means for said drop chutes movable relative to the trays on said tray conveyor to position and release cookies from said drop chutes for loading into said compartments, and means providing dwells in travel of said trays along said tray conveyor upon release movement of said release means.

2. The cookie loading apparatus of claim 1, including first and second drop chutes converging toward each other and having oppositely moving drop gate slides, wherein the converging ends of said drop chutes are each positioned in an alignment with an adjacent cookie receiving compartment upon each dwell in travel of said trays.

3. The cookie loading apparatus of claim 1, wherein the tray conveyor is a continuously moving conveyor and stop fingers are engageable with said trays to stop movement of said trays in alignment with the discharge ends of said drop chutes in position to accommodate the dropping of cookies into successive of said compartments.

4. The cookie loading apparatus of claim 1, wherein the first drop gate slide is laterally movable to open the outlet end of the first of said drop chutes and the second drop gate slide is laterally movable to simultaneously open the outlet end of the second of said drop chutes.

5. The apparatus of claim 1, including means to move said first and second drop gate slides to simultaneously open the bottoms of said drop chutes to discharge cookies into the succeeding compartments of said trays during dwells in travel thereof.

6. The cookie loading apparatus of claim 5, in which the tray conveyor is a continuously moving conveyor and stop means are movable into position to engage succeeding trays in said tray conveyor and position said trays beneath said drop chutes.

7. The cookie loading apparatus of claim 6, in which the stop means are rockably movable and the means operating said stop means is timed to engage said stop means with said trays upon movement of said drop gate slides into position to release cookies from said drop chutes, and to disengage said stop means from said trays, upon the loading of cookies in the compartments disposed beneath the discharge ends of said drop chutes.

8. The cookie loading apparatus of claim 1, in which one of said drop chutes has continuous end walls terminating into parallel discharge ends, and a vertical transfer wall forms a downward continuation of a vertical end wall of the other of said drop chutes, and means are provided for moving said transfer wall laterally of said chute to a tray loading position.

9. The cookie loading apparatus of claim 8, wherein said drop chutes have oppositely moving drop gate slides closing the discharge ends thereof and movable laterally in opposite directions, and the slide associated with said transfer wall is movable in a direction opposite to movement of said transfer wall simultaneously with movement of the other of said drop gate slides.

10. The cookie loading apparatus of claim 9, wherein a power operated lever arm is provided to move said drop gate slides in opposite directions to open said drop chutes.

11. The cookie loading apparatus of claim 10, wherein a power operated lever arm is provided to operate at least one of said drop gate slides to open the associated drop chute, a cross linkage operated by said lever arm connects said drop gate slides to move in opposite directions, and fluid pressure operated cylinder and piston means are provided to move said vertical transfer wall in a direction opposite to movement of the drop gate slide associated with said vertical transfer wall.

12. The cookie loading apparatus of claim 11, wherein an equalizer linkage stabilizes movement of said transfer wall.

13. The cookie loading apparatus of claim 12, wherein cam means and valves operated thereby are provided to supply fluid under pressure to said cylinder and piston means to move said vertical transfer wall in a direction to shift said wall and align the discharge end of said chute in association with a compartment succeeding the compartment in association with said associated drop chute and the cam means is operated in timed relation with respect to movement of said drop chute slides.

14. In combination with an apparatus for loading articles such as cookies and the like having at least two parallel sides, into trays having at least a pair of successively arranged generally parallel closely spaced article receiving compartments, in which the articles are supplied in a pair of spaced-apart rows, with each row separated into aligned groups of the same predetermined quantity, a transfer conveyor transferring groups of cookies for loading, said transfer conveyor having first and second drop gate means, each supporting a row of aligned cookies for movement into a loading position, means to activate said first and second drop gate means to accommodate the loading of cookies into successive compartments in said trays, leading and trailing drop chutes mounted beneath said drop gate means, a tray conveyor extending transversely of said transfer conveyor and disposed therebeneath, said drop chutes having receiving ends in cookie receiving relation relative to said drop gate means and discharge ends in cookie discharge relation relative to said successively arranged compartments, drop gate slides closing the discharge ends of said drop chutes, and means driven in timed relation with respect to operation of said drop gates for moving said drop gate slides oppositely of each other to open the outlet ends of said leading and trailing drop chutes to discharge groups of cookies into successive of said compartments.

15. The loading apparatus of claim 14, in which said drop chutes converge toward each other to position the discharge ends of said chutes in alignment with successive of said compartments.

16. The article loading apparatus of claim 15, in which said drop chute slides are concurrently operated in opposite directions by motion transfer links rockably movable in timed relation with respect to said drop gates.

17. The article loading apparatus of claim 15, wherein the leading drop chute extends straight downwardly and the trailing drop chute has a lower transfer wall at least as high as an article to be loaded, and wherein means operated in timed relation with respect to said drop gate slides are provided to move said transfer wall oppositely of the associated drop chute slide into position to accommodate the dropping of cookies into the succeeding of said compartments.

18. The loading apparatus of claim 17, including fluid pressure operated cylinder and piston means for moving said transfer wall to a cookie discharge position, and means controlling operation of said fluid pressure operated cylinder and piston means including a control valve, and cam means driven in timed relation relative to the associated drop gate slides operate said valve to admit fluid under pressure to said cylinder and piston means, to advance said transfer wall into a loading position prior to movement of the associated drop gate slides out of supporting engagement with respect to a group of cookies.

* * * * *